US005148733A

United States Patent [19]

Beller

[11] Patent Number: 5,148,733

[45] Date of Patent: Sep. 22, 1992

[54] POLE PIECE FOR AN ELECTRIC STRING INSTRUMENT TO DECREASE MAGNETIC FLUX INTENSITY AROUND STRINGS

[75] Inventor: Kevin Beller, Santa Barbara, Calif.

[73] Assignee: Seymour Duncan Corporation, Santa Barbara, Calif.

[21] Appl. No.: 488,925

[22] Filed: Mar. 5, 1990

[51] Int. Cl.[5] ..... G10H 3/18; G10H 3/08

[52] U.S. Cl. ..... 84/726; 84/725; 84/743; 367/176

[58] Field of Search ..... 84/726, 728, 725, 727, 84/DIG. 24, 742, 743, 723; 367/176

[56] References Cited

U.S. PATENT DOCUMENTS

| | | | |
|---|---|---|---|
| 2,968,204 | 1/1961 | Fender . | |
| 3,147,332 | 8/1961 | Fender . | |
| 3,177,283 | 8/1961 | Fender . | |
| 3,290,424 | 3/1964 | Fender . | |
| 3,585,311 | 6/1971 | Zoller . | |
| 3,588,311 | 1/1971 | Zoiler . | |
| 3,902,394 | 9/1975 | Stich . | |
| 3,916,751 | 11/1975 | Stich . | |
| 3,983,777 | 10/1976 | Bartolini . | |
| 3,983,778 | 10/1976 | Bartolini . | |
| 4,133,243 | 1/1979 | DiMarzio . | |
| 4,220,069 | 9/1980 | Fender . | |
| 4,283,982 | 8/1981 | Armstrong . | |
| 4,320,681 | 3/1982 | Altilio . | |
| 4,348,930 | 9/1982 | Chobanian et al. | 84/726 |
| 4,499,809 | 2/1985 | Clevinger | 84/726 |
| 4,765,219 | 8/1988 | Alm | 84/726 |
| 4,809,578 | 3/1989 | Lace . | |

*Primary Examiner*—William M. Shoop, Jr.
*Assistant Examiner*—Helen Kim

[57] ABSTRACT

A pole piece for an electric string instrument comprised of a block of ferrous material having a slot formed therein. The string of the string instrument passes over the pole piece in aligned relationship with the slot thereby allowing vibration in a zone which is substantially free of any intense magnetic flux lines.

13 Claims, 6 Drawing Sheets

SOLID CYLINDER PRIOR ART

McDOUGALL PRIOR ART

POLE PIECE FOR AN ELECTRIC STRING INSTRUMENT TO DECREASE MAGNETIC FLUX INTENSITY AROUND STRINGS

BACKGROUND OF THE INVENTION

The invention relates to the field of magnetic pickups for electric guitars, and more particularly, to an improved pole piece for an electric guitar having a configuration such that the magnetic field does not substantially interfere with the vibration of the string.

In the prior art, solid circular pole pieces have been used to direct the magnetic field from a permanent magnetic upward to the vicinity of a ferromagnetic guitar string. When the string is plucked, the vibrating string interacts with the magnetic field to cause changes in the paths of the flux lines. These changes occur at the same frequency or frequencies and intensity as the string vibrations. A coil wrapped around the pole piece generated a signal as the changing flux lines cut across the wires of the coil. This signal should have had all the frequency and intensity characteristics of the vibrating string if the string had been vibrating freely.

Unfortunately this was not the case. A freely vibrating guitar string has a very complex vibration pattern in the form of a precessing ellipse. The vibration has both primary and harmonic frequency components. Various characteristics of the vibration are important to good tonal quality in an electric guitar. Among the most important of these characteristics are: the length the vibrations lasts, i.e., the so-called "note sustain"; the richness (completeness) of the harmonic content reproduction; the accuracy of reproduction of the spectral content of the string vibration as the string is shortened or lengthened by pressing it against various frets on the fretboard; and, the reproduction of an "open" or "natural" sound.

The quality of the magnetic design of the pole piece in the guitar pickup has a great deal to do with whether or not these characteristics are achieved. If the pole piece is designed such that the guitar string passes through a significant portion of the magnetic field, the magnetic forces acting the guitar string will adversely alter the vibrational characteristics of the string. These forces dampens vibrations thereby reducing "note sustain". Further, the forces dampen certain harmonics more than others thereby altering the spectral content of the output signal. This adversely affects richness of the sound, the accuracy of note intonation and the "naturalness" of the sound.

Not only does the magnetic field dampen certain harmonics but it also alters the natural vibrational pattern of the string in a way that creates distortion in the output signal. The sonic effect can vary from sounding slightly harsh in minor cases to actually making the note sound out of tune in extreme cases.

One worker in the art attempted to solve this problem by making the pole piece a hollow tube made of ferromagnetic material. This design is detailed in U.S. Pat. No. 4,624,172 to McDougall. Unfortunately, the McDougall design did not completely solve the problem of string vibration dampening by the magnetic field of the pickup. Although the McDougall design did make some improvement over the solid pole pieces of the past, it has been discovered by the applicant that the McDougall design made surprisingly little improvement over the prior art.

Accordingly, a need exists for an improved pole piece design which does not substantially dampen string vibration.

SUMMARY OF THE INVENTION

According to the teachings of the invention, there is disclosed a new pole piece design comprised of a cylindrical or rectangular solid of ferromagnetic material in which a slot is cut. The centerline of the slot coincides with the path of the string of the instrument when the pole piece is in assembled position adjacent to the permanent magnet. For a six string electric guitar, the pole piece is preferably a one piece solid with six slots comprised of a lower rectangular section of ferromagnetic material with six periodically spaced uprights of ferromagnetic material, each having the shape of a tuning fork. The uprights of the tuning fork can be of either a rectangular or cylindrical cross section. In alternative embodiments, the upright sections may be comprised of two individual, spaced-apart and parallel solids of ferromagnetic material of either rectangular or cylindrical cross-sectional shape. Other shapes may also work. These pairs of solids are spaced apart sufficiently to create a clear path for the instrument string to pass overhead with no ferromagnetic material directly underneath the string. This pole piece is placed adjacent a permanent magnet so as to form a magnetic circuit such that a string of ferromagnetic material vibrating in the slot will change the reluctance of the gap across the slot at the frequencies of vibration.

Of course the teachings of the invention are not limited to use in electric guitars. The invention finds application in any electrically amplified string instrument such as a violin, cello, harp, banjo, mandolin, steel guitar, etc. All such instruments will hereafter be referred to as "electric string instruments".

The fundamental concept behind the teachings of the invention is that a string or an electric string instrument should be allowed to vibrate freely without interference from forces acting on the string generated by the magnetic pickup. In embodying this concept according to the teachings of the invention, any pole piece configuration which defines a zone in which a ferrous string may vibrate substantially free of magnetic forces acting upon the string will suffice to practice the invention. Generally, all such embodiments will be free of any ferromagnetic material of the pole piece lying directly under the centerline of the string. Preferably, no ferromagnetic material will lie under the locus of all points traveled by the centerline of the string during vibration of the string.

DETAILED DESCRIPTION OF THE PREFERRED EMBODIMENT

Figure 1:
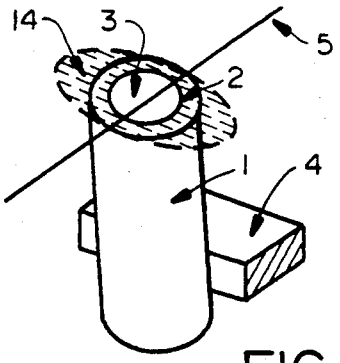
FIG. 1 PRIOR ART
FIG. 1 is a prior art pole piece.

Referring to FIG. 1, there is shown a prior art pole piece such as is described in the McDougall patent, U.S. Pat. No. 4,624,172. The pole piece 1 is a hollow cylinder of ferromagnetic material. A guitar string 5 spans the circumferential end rim 2, and is spaced slightly above the rim and above a hollow center bore 3 running the vertical length of the pole piece. Magnetic flux 14 is guided from the permanent magnet 4 through the material of the pole piece to form the magnetic field 14 in which the string 5 vibrates.

Figure 2:
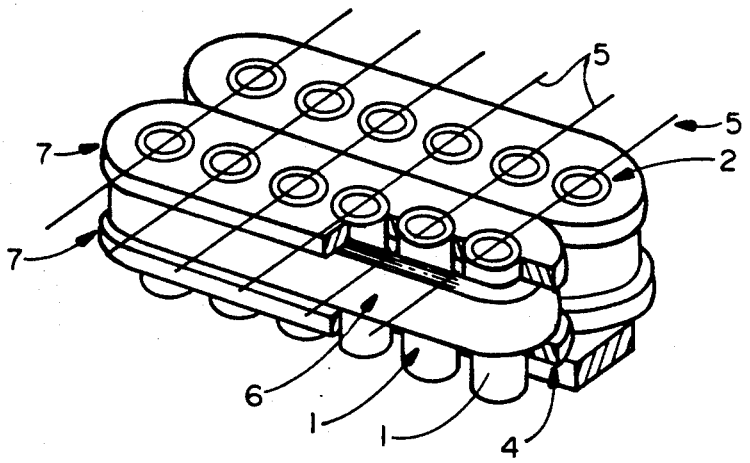
FIG. 2 PRIOR ART
FIG. 2 is a diagram of how the prior art pole piece of FIG. 1 is used in a magnetic pickup for a six string guitar.

Referring to FIG. 2, the manner in which the prior art pole piece of FIG. 1 is used in a magnetic pickup for a guitar is shown. Bobbin plates 7 confine a coil 6 of wire which is wound around a plurality of pole pieces 1. The end rims 2 of the pole pieces are flush with the top surface of the one of bobbin plates 7 which is farthest from the permanent magnet 4. The pole pieces 1 are placed adjacent the magnet 4 to conduct magnetic flux upward to the vicinity of the strings 5. As the strings vibrate, they alter the paths of the magnetic flux lines at the same fundamental and harmonic frequencies at which the string is vibrating. These moving flux lines cut across the wires of the coil 6 and generate voltages therein which define a signal having at least some if not all of the frequency characteristics of the vibrating strings.

Not all the frequency characteristics of the vibrating strings are faithfully reproduced in the signal. More precisely the signal picked up by the coil 6 does not have all the frequency characteristics, e.g., number and intensity of fundamental frequencies and harmonics thereof, as would be present in the freely vibrating strings 5 if the magnetic pickup shown in FIG. 2 were not present. That is, the magnetic fields generated by the magnet 4 and pole pieces 1 in which the strings 5 vibrate exert forces on the ferrous strings 5 which alter the vibration characteristics of the strings. Specifically the duration and amplitude of vibration suffers damping and some or all harmonics are suppressed or otherwise altered thereby altering the "sound" of the string by changing its spectral content.

Figure 3:
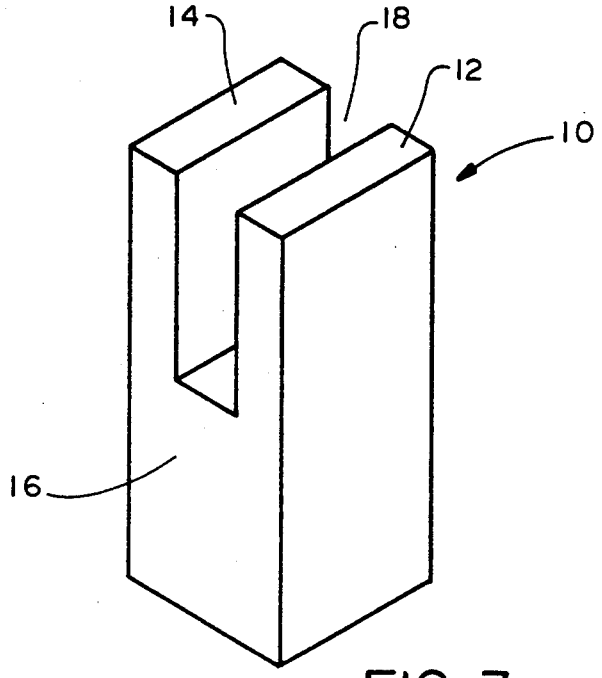
FIG. 3 is a perspective view of one embodiment of a pole piece according to the teachings of the invention.

FIG. 3 shows a perspective view of one embodiment of a pole piece according to the teachings of the invention. The pole piece 10 is made of ferrous material of high magnetic permeability. In the embodiment shown in FIG. 3, two solid projections 12 and 14 having rectangular cross sections are formed in the pole piece 10. A lower section, also of rectangular cross section supports the projections 12 and 14 in spaced apart relationship to define s slot 18 therebetween. The slot 18 has a rectangular perimeter in the preferred embodiment.

In manufacturing the pole piece 10, either casting or machining the pole piece from a rectangular cross section solid of ferrous material will suffice. The slot 18 should have a depth sufficient to prevent magnetic flux guided by the pole piece from substantially interfering with the vibration of a ferrous string passing over the slot in aligned relationship. In the preferred embodiment, the pole piece 10 is manufactured of 16 AWG C.R. Steel, and the slot 18 is 0.230 to 0.260 inches deep.

The pole piece according to the invention is marketed by Seymour Duncan Corporation of Santa Barbara, Calif. under the trademark TREMBUCKER.

Figure 4:
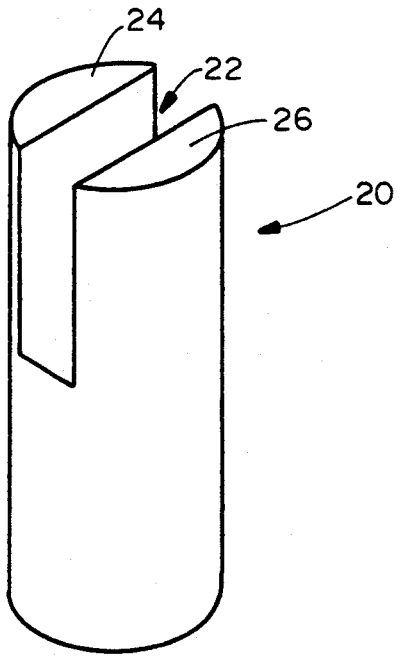
FIG. 4, 5 and 6 are other embodiments of the pole piece of the invention.

FIG. 4 shows another embodiment of a pole piece according to the teachings of the invention. The pole piece 20 is comprised of a solid cylinder of ferrous material such as 16 AWG C.R. Steel having a slot 22 formed therein. Again, the width and depth of the slot 22 is such that magnetic flux guided by the pole piece 20 upward from a magnet (not shown) positioned adjacent the base of the pole piece does not substantially interfere with the vibration of the string. In the embodiment shown in FIG. 4, the spaced-apart, upright solid projections 24 and 26 which define the slot 22 have semicircular or crescent shaped cross-sections.

Figure 5:
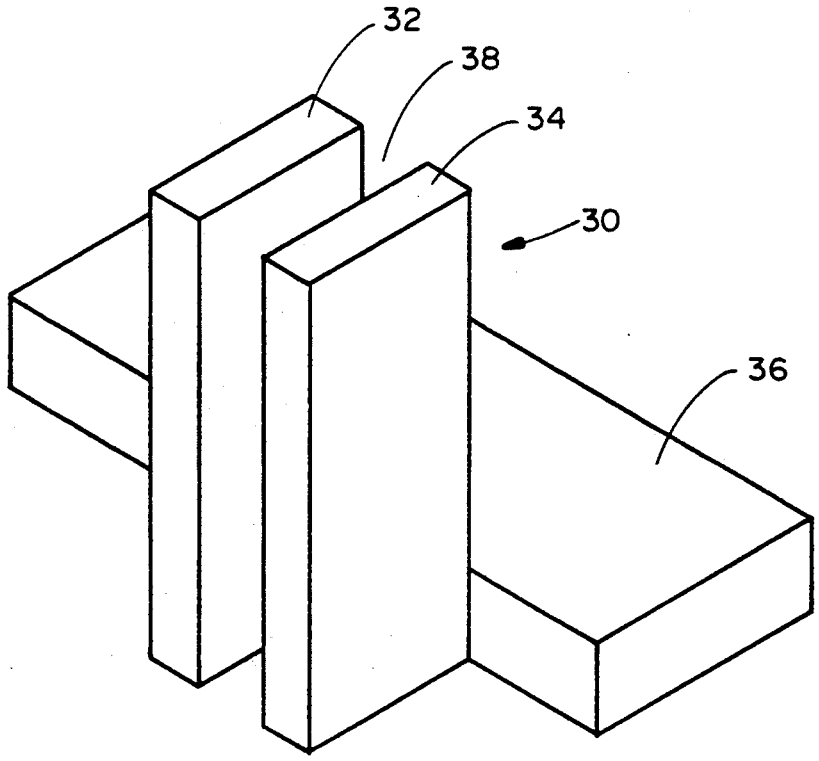

FIG. 5 shows another embodiment of a pole piece according to the teachings of the invention. In the embodiment of FIG. 5, the pole piece 30 is comprised of two individual ferrous solids 32 and 34 of rectangular cross section which are placed adjacent to a magnet 36. The solids 32 and 34 are supported in parallel, spaced-apart relationship to define a slot 38 therebetween.

Figure 6:
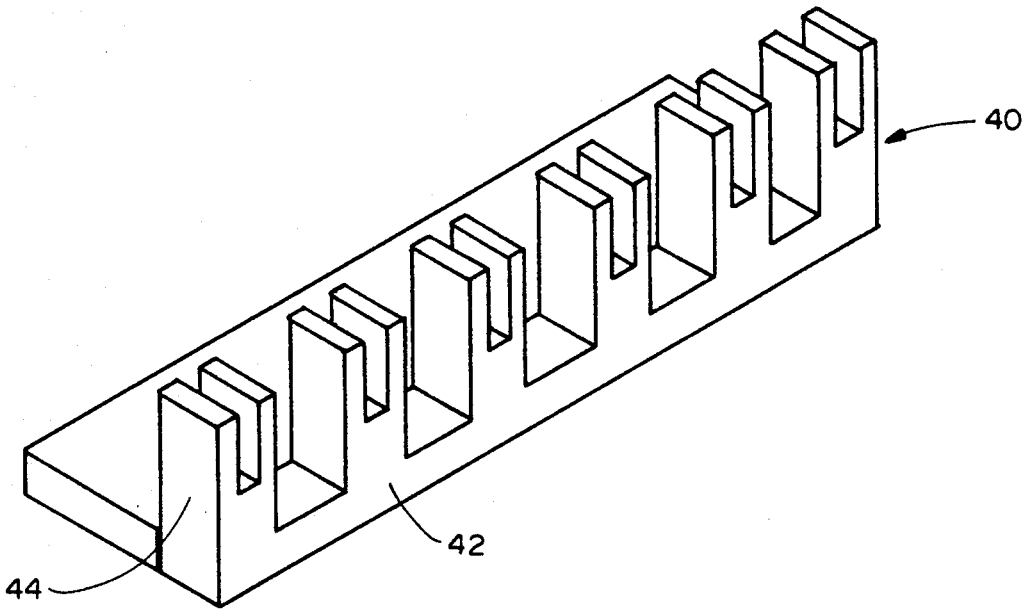

FIG. 6 shows a pole piece and magnet combination for a six string electric guitar. In the embodiment of FIG. 6, the pole piece 40 is comprised of a lower ferous solid 42 of rectangular cross-section having formed thereon six periodically spaced "uprights", each comprised of a ferrous solid of rectangular cross-section having a rectangular perimeter slot formed therein of which upright 44 is typical. Of course, the uprights can also have the configuration of the embodiments shown in FIGS. 4 or 5 in other embodiments.

Figure 7:
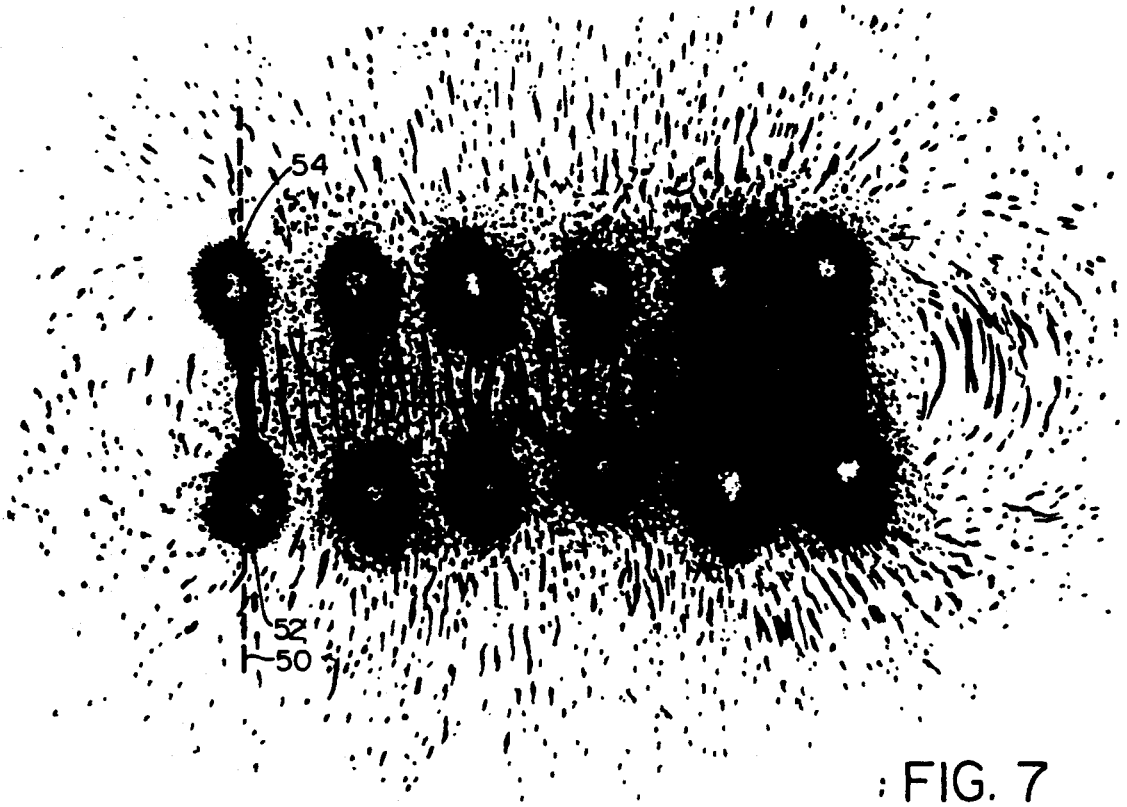
FIG. 7 is an illustration of the magnetic flux pattern created by a solid, cylindrical prior art pole piece.

FIG. 7 is a tracing of an actual photograph of the magnetic flux lines in a magnetic field created by a solid cylinder pole piece existing in the prior art since 1959. The photograph was made by the assignee of the present invention by setting a piece of paper on top of the pole piece and sprinkling iron filings on the paper. The paper was then agitated until the iron filings lined up with the magnetic flux lines. The path of one string over the pole piece is shown as a dashed line 50. Note the heavy concentration of flux lines at 52 and 54 and at diametrically opposed points on the perimeter of the pole piece uprights under the path 50 of the string. The configuration of the pole piece in FIG. 7 is that shown in FIGS. 3A, 3B or 3C in the McDougall U.S. Pat. No. 4,624,172.

Figure 8:
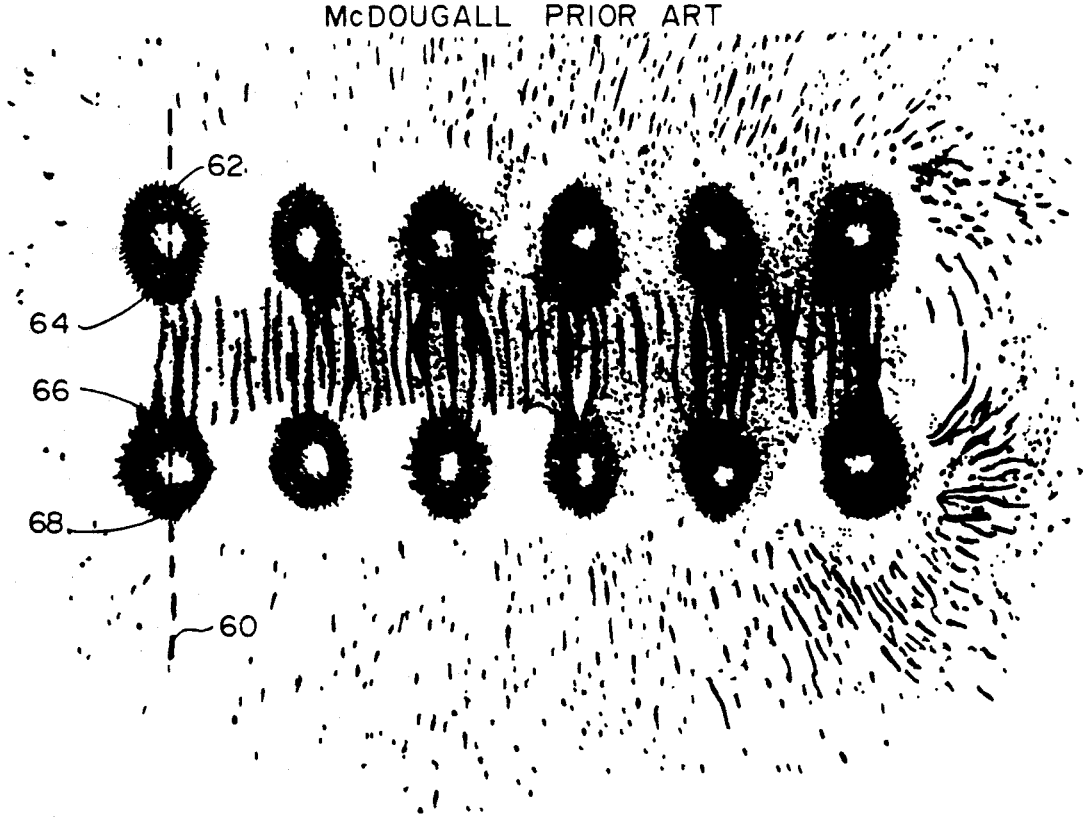
FIG. 8 is an illustration of the magnetic flux pattern created by a hollow, cylindrical pole piece of the prior art.

FIG. 8 shows the magnetic flux pattern created by the McDougall pole piece of the prior art. Note that the McDougall pole piece does not create a substantially improved magnetic flux pattern compared with the other type of prior art pole piece shown in FIG. 7. In particular, note the fairly intense concentration of magnetic flux lines at points 62, 64, 66 and 68 at the perimeter of the pole piece under the path 60 of the string.

In both the embodiments of prior art pole pieces creating the magnetic flux patterns represented by FIGS. 7 and 8, significant interference with the string vibration occurs. The magnetic flux lines at the perimeter of each pole piece upright through which the string passes cause forces to act on the string which dampen the vibration and adversely affect the spectral content of the output signal from the pickup coil.

Figure 9:
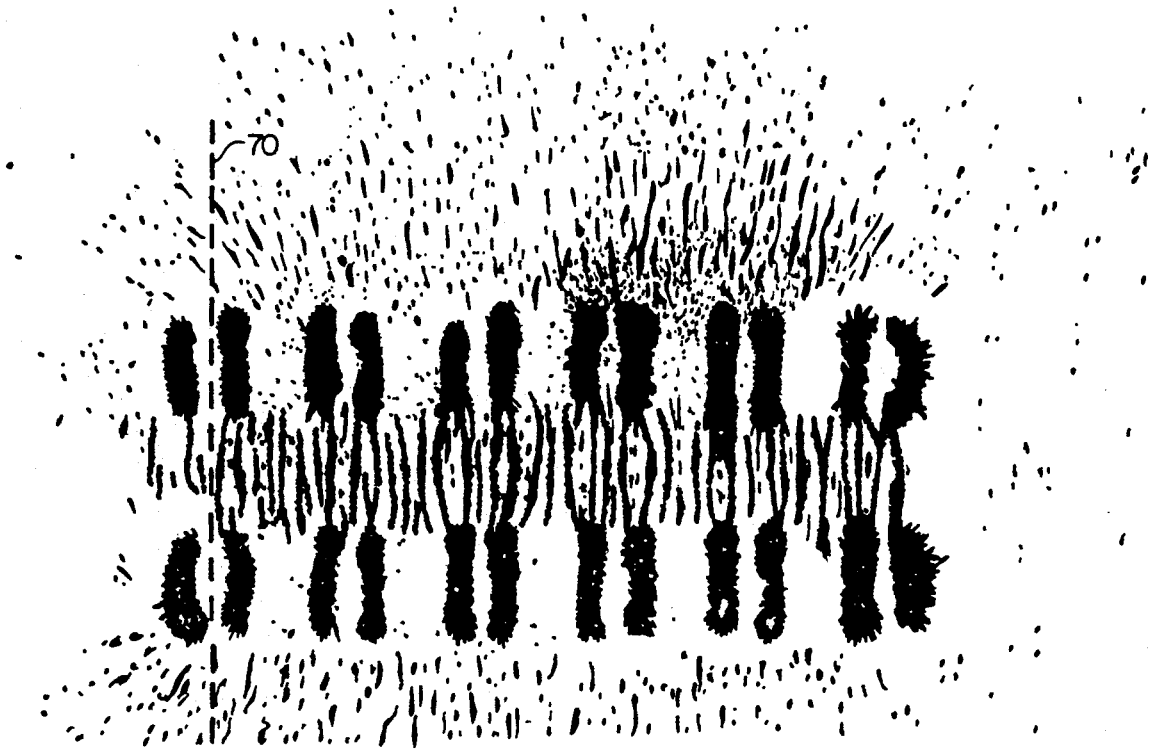
FIG. 9 is an illustration of the magnetic flux pattern of a pole piece according to the teachings of the invention.

FIG. 9 shows the magnetic flux pattern generated by the pole piece according to the teachings of the invention. Note that the path 70 of the string is essentially free of any intense flux line concentration. Thus, there is substantially less force acting on the string to adversely affect the spectral content of the output signal.

Figure 10:
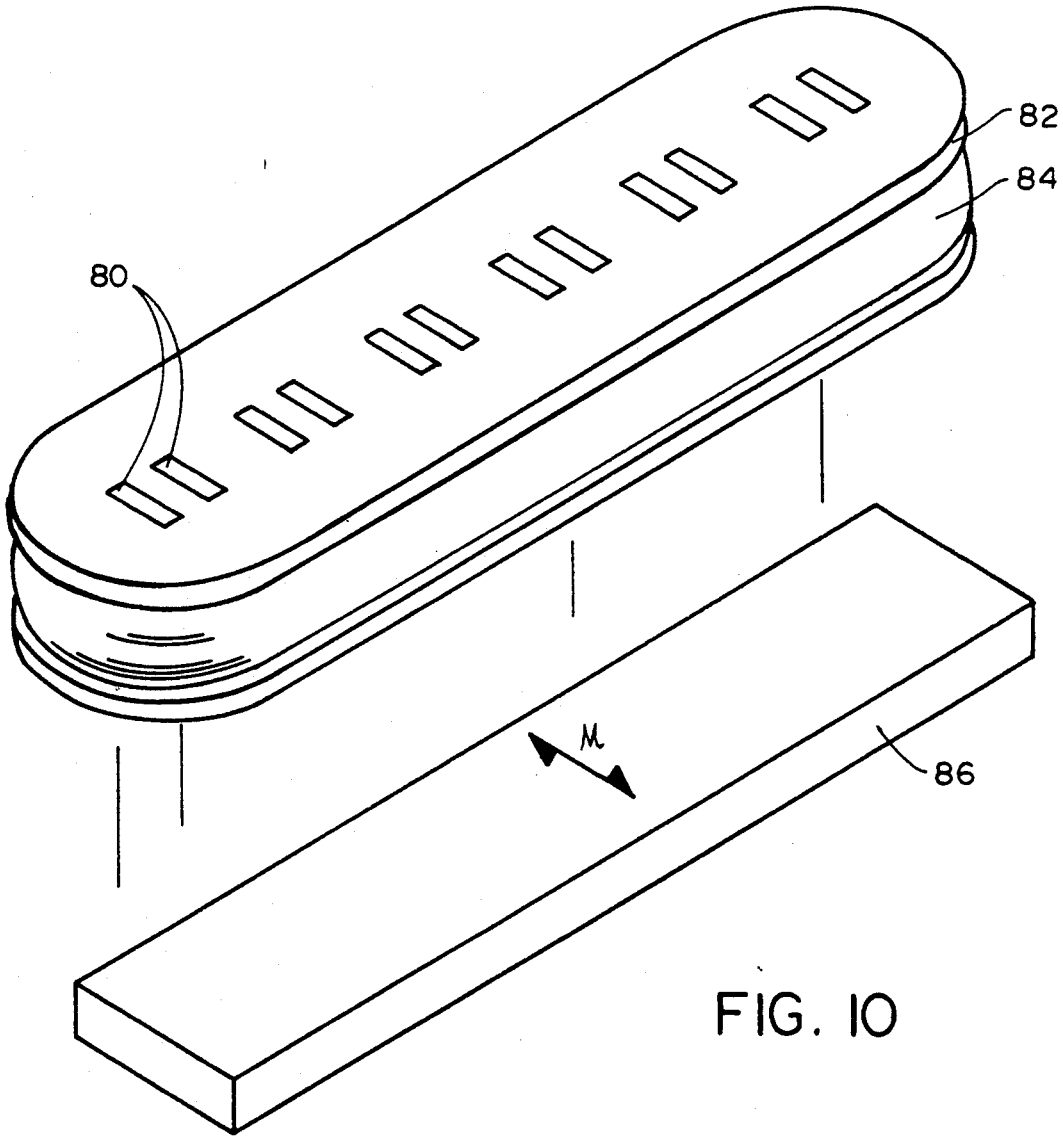
FIG. 10 is a perspective view of a guitar pickup according to the teachings of the invention.
Figure 11:
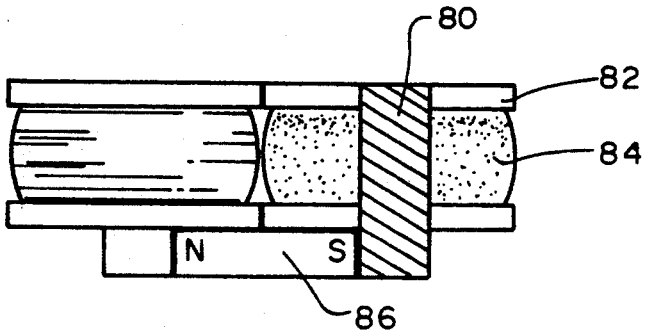
FIG. 11 is a sectional view of the guitar pickup of FIG. 10.

FIG. 10 shows a perspective view of a completely assembled guitar pickup pole piece. The end surfaces of the pole piece uprights are shown typically at 80. A bobbin 82 of nonconductive material such as nylon surrounds the pole piece. Around the bobbin, there is wrapped a pickup coil 84. The pole piece 80, bobbin 82 and coil 84 are placed adjacent a magnet 86 as shown in FIG. 11 which shows a cross-sectional view of the guitar pickup assembly. Elements in FIGS. 10 and 11 which correspond to each other have the same reference numbers.

Figure 12:
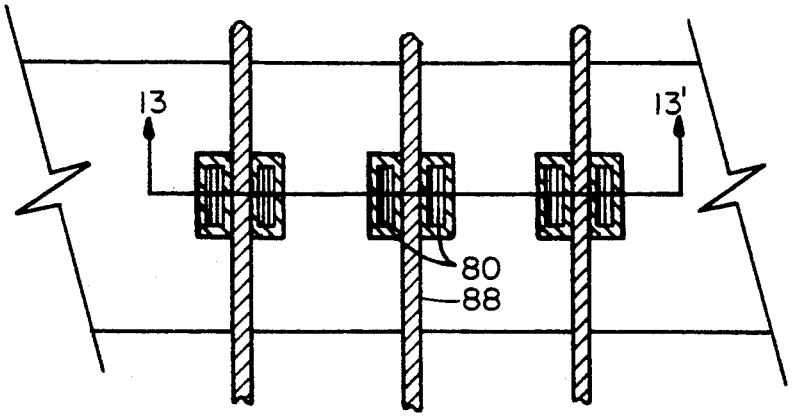
FIG. 12 is a top view of three string positions of a guitar pickup according to the teachings of the invention.

FIG. 12 is a top view of a guitar pickup according to the teachings of the invention showing the path of the guitar strings, of which string 88 is typical, passing between the pole piece uprights.

Figure 13:
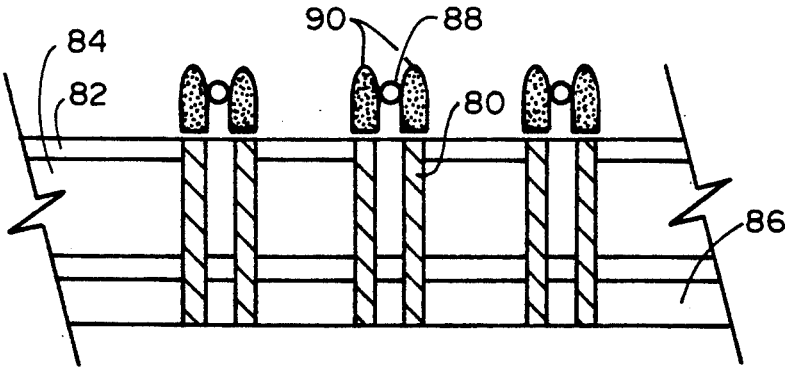
FIG. 13 is a sectional view of three string positions of the pole piece of FIG. 12.

FIG. 13 shows a cross-sectional view through the pole piece taken along section line 13—13' in FIG. 12. FIG. 13 shows the magnetic flux symbolically at 90.

Although the invention has been described in terms of the preferred and alternative embodiments described herein, those skilled in the art will appreciate other embodiments which do not depart from the spirit and scope of the teachings of the invention. All such embodiments are intended to be included within the scope of the claims appended hereto.

I claim:

1. A pole piece for a magnetic pick-up of an electric string instrument having a string which vibrates in an area adjacent said pole piece, comprising first and second ferrous solids, each having a cross sectional shape, and in spaced-apart relationship so as to define a slot therebetween, said cross sectional shape, spaced-apart relationship and slot causing a magnetic flux pattern which minimizes the magnetic flux intensity in the area in which said string vibrates.

2. The apparatus of claim 1 wherein the cross sectional shape of said first and second solids is such that said slot has a rectangular perimeter.

3. The apparatus of claim 1 wherein the cross-section of said first and second solids is rectangular.

4. The apparatus of claim 1 wherein the cross-section of said first and second solids is crescent-shaped.

5. A pole piece for a magnetic pick-up of an electric string instrument having a magnetically permeable string which vibrates in an area over said pole piece, and wherein said pole piece is comprises of a solid of magnetically permeable material having a rectangular cross-section when cut perpendicular to the long axis and having a slot formed therein, said cross-section and slot dimensions established so as to minimize the magnetic flux intensity in said area of vibration of said string so as to minimize the magnetic attraction forces acting on said string which alter the tonal qualities of said vibration.

6. The apparatus of claim 5 wherein said slot has a rectangular perimeter.

7. The apparatus of claim 6 wherein said slot has a depth sufficient to prevent magnetic flux from substantially interfering with the vibration of a string of ferrous material passing over said slot.

8. The apparatus of claim 7 wherein said slot has sufficient width such that magnetic flux does not substantially interfere with vibration of a string of ferrous material vibrating over said slot.

9. A pole piece of a magnetic pickup of an electric string instrument having a vibrating string, comprised of solid ferrous material having a cylindrical cross section and having a slot formed therein said slot being parallel to said string so as to minimize the intensity of magnetic flux in the area in which the string of said string instrument vibrates.

10. The apparatus of claim 9 wherein said slot has a rectangular cross section.

11. The apparatus of claim 9 wherein said slot has sufficient depth to prevent magnetic flux from substantially interfering with the vibration of a string of ferrous material passing over said slot.

12. An apparatus as defined in claim 11 wherein said slot has sufficient width to prevent magnetic flux from substantially interfering with the vibration of a string of ferrous material passing over said slot.

13. A pole piece for a magnetic pickup of an electric string instrument having a vibrating string, said pole piece comprising a first section of ferrous material having a rectangular cross-section and having a plurality of periodically spaced uprights of ferrous material defining a plurality of slots, said slots arranged relative to the area of vibration of said string so as to minimize the intensity of magnetic flux in the area wherein said string vibrates when said pole piece is positioned adjacent a magnet in a magnetic circuit.

* * * * *